US009274470B2

(12) United States Patent
Nakayama

(10) Patent No.: US 9,274,470 B2
(45) Date of Patent: Mar. 1, 2016

(54) FIXING APPARATUS AND IMAGE FORMING APPARATUS

(71) Applicant: CANON KABUSHIKI KAISHA, Tokyo (JP)

(72) Inventor: Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/323,229

(22) Filed: Jul. 3, 2014

(65) Prior Publication Data

US 2015/0016853 A1 Jan. 15, 2015

(30) Foreign Application Priority Data

Jul. 9, 2013 (JP) ..... 2013-143643

(51) Int. Cl.
*G03G 15/20* (2006.01)

(52) U.S. Cl.
CPC ..... *G03G 15/206* (2013.01); *G03G 15/2053* (2013.01); *G03G 2215/2035* (2013.01)

(58) Field of Classification Search
CPC ..... G03G 15/206
USPC ..... 399/329
See application file for complete search history.

(56) References Cited

U.S. PATENT DOCUMENTS 6,475,573 B1 * 11/2002 Veerasamy et al. ..... 427/523
6,713,725 B2 * 3/2004 Izawa et al. ..... 399/329

FOREIGN PATENT DOCUMENTS

JP 2003-057978 A 2/2003
JP 2009-058661 A 3/2009
JP 2010-122450 A 6/2010

OTHER PUBLICATIONS

A. C. Ferrari et al., "Interpretation of Raman Spectra of Disordered and Amorphous Carbon," 61 (20) Phys. Rev. B 14095-14107 (May 2000).

* cited by examiner

*Primary Examiner* — Walter L Lindsay, Jr.
*Assistant Examiner* — Ruth Labombard
(74) *Attorney, Agent, or Firm* — Fitzpatrick, Cella, Harper & Scinto

(57) ABSTRACT

A fixing apparatus includes a first member that is heated by a heat source and is rotatable; a second member that is rotatable, the second member forming a nip portion capable of sandwiching a recording material between the first member and the second member; and a pressure member that is disposed inside the first member, has a surface coming into contact with an inner surface of the first member, and pressurizes the first member against the second member, in which the pressure member has a surface layer forming the surface of the pressure member coming into contact with the inner surface of the first member, and the surface layer includes a diamond-like carbon film having an $sp^3$ bond ratio of 40% or more and 90% or less.

8 Claims, 5 Drawing Sheets

J.ROBERTSON: MATERIALS SCIENCE AND ENGINEERING, R37 (2002) 129-281

FIXING APPARATUS AND IMAGE FORMING APPARATUS

BACKGROUND OF THE INVENTION

1. Field of the Invention

The present invention relates to a fixing apparatus and an image forming apparatus including the fixing apparatus.

2. Description of the Related Art

Hitherto, a heat roller system has been frequently used as a heating apparatus for an image forming apparatus. In addition, a heating apparatus of a film heating system has been put into practical use in recent years from the viewpoints of a quick start and energy saving.

Available as a fixing apparatus of the film heating system is an apparatus including a heater including a resistance heating element on a substrate made of ceramics, a flexible member (fixing belt) that moves while being in contact with the heater, a sliding pressure member, and a pressure roller.

The sliding pressure member is disposed inside the fixing belt and is pressurized while sliding on an inner surface of the fixing belt. The pressure roller forms a nip portion with the sliding pressure member through the fixing belt. A recording material bearing an unfixed toner image is heated while being sandwiched and conveyed at the nip portion of the fixing apparatus. Thus, the image on the recording material is heated and fixed onto the recording material.

The fixing apparatus has the advantage that it requires only a short time to attain a temperature for image fixation after the start of supplying electric power to the heater. Accordingly, a printer mounted with the fixing apparatus can shorten a time period required from input of a print command to output of the first image. In addition, the fixing apparatus of this type has the advantage that power consumption is small while it is ready and waiting for the print command.

A heat capacity of the film serving as a heating member of the fixing apparatus of the film heating system is smaller than that of a fixing apparatus of the heat roller system. Accordingly, regulation of the heater temperature and control of paper feeding have been performed according to the size and kind of the recording material onto which an image is to be fixed.

However, in such fixing apparatus of the film heating system having a low heat capacity, the sliding pressure member is pressurized while sliding on the inner surface of the fixing belt, and hence a rotational torque occurs. In general, sliding grease or the like is applied to the inside of the fixing belt to reducing the rotational torque.

However, when the sliding grease deteriorates over time, or is thermally decomposed or depleted, the rotational torque increases.

When the rotational torque increases, faulty rotation of the fixing belt is liable to occur, and hence abnormal noise due to a stick-slip phenomenon or faulty images called an image slip due to delayed paper conveyance may occur. Measures given below have been known as measures against such increase in the torque of the fixing apparatus.

Japanese Patent Application Laid-Open No. 2003-57978 discloses a heater whose surface coming into contact with a fixing belt is coated with a sliding layer having a thickness of 10 μm or less. An imide-based resin such as polyimide or polyamide imide, a fluorine-based resin, or the like has been used as a material for the sliding layer. Examples of the fluorine-based resin include a tetrafluoroethylene-perfluoroalkyl vinyl ether copolymer (PFA) and polytetrafluoroethylene (PTFE).

In addition, Japanese Patent Application Laid-Open No. 2009-58661 discloses an invention which aims to improve quality of a fixed image by: imparting conductivity to a heat-resistant resin belt that forms an image forming apparatus to reduce static electricity; and improving abrasion resistance of a film to effectively prevent the film from peeling. It is also disclosed that the aim can be achieved by a heat-resistant resin belt having formed on its inner circumferential surface a coating layer having a Vickers hardness of 3,000 Hv or more and a surface resistance value of $10^5\Omega\cdot$cm or less.

Japanese Patent Application Laid-Open No. 2009-58661 discloses, as an example of such coating layer, a diamond-like carbon film (hereinafter sometimes referred to as "DLC film") having a Vickers hardness of 3,000 Hv or more and a surface resistance of $10^2\Omega\cdot$cm. In addition, Japanese Patent Application Laid-Open No. 2009-58661 discloses, as an example of the coating layer, a tetrahedral amorphous carbon film (hereinafter sometimes referred to as "ta-C film") having a Vickers hardness of about 5,000 Hv and a surface resistance of $10^2\Omega\cdot$cm. It should be noted that the ta-C film is one kind of the DLC film and is an amorphous carbon-based hard thin film free of hydrogen.

As a result of an investigation, the inventor of the present invention has recognized that when the endless heat-resistant resin belt provided with the DLC film or ta-C film as the coating layer according to Japanese Patent Application Laid-Open No. 2009-58661 is applied to a fixing member to be placed in such a state that the coating layer slides on a pressure member, such problems as described below occur.

That is, when the coating layer formed of the DLC film or ta-C film having such flexibility as to be capable of following the bending property of the resin belt is placed in such a situation that the pressure member always slides on the coating layer, its durability has not yet been sufficient. Accordingly, when the fixing apparatus is used over a long period of time, a frictional resistance between the inner circumferential surface of the endless heat-resistant resin belt and the pressure member increases owing to, for example, peeling of the coating layer, and hence the rotational torque of the heat-resistant resin belt may increase, or stick-slip (sticking) may occur in some cases. In addition, abnormal noise or faulty electrophotographic images resulting from the foregoing phenomena may occur in some cases.

SUMMARY OF THE INVENTION

In view of the foregoing, the present invention is directed to providing a fixing apparatus capable of stably performing a fixing operation because a frictional resistance between a heat-resistant resin belt and a pressure member disposed in contact with its inner circumferential surface hardly increases even after long-term use.

According to one aspect of the present invention, there is provided a fixing apparatus including: a first member that is heated by a heat source and is rotatable; a second member that is rotatable, the second member forming a nip portion with the first member, the nip portion being capable of sandwiching a recording material; and a pressure member that is disposed inside the first member, has a surface coming into contact with an inner surface of the first member, and pressurizes the first member against the second member, in which a surface layer of the pressure member, coming into contact with the inner surface of the first member, includes a diamond-like carbon film having an $sp^3$ bond ratio of 40% or more and 90% or less.

According to another aspect of the present invention, there is provided an image forming apparatus, including a fixing apparatus that heats an unfixed toner image on a recording material to fix the image onto the recording material, in which the fixing apparatus includes the above-mentioned fixing apparatus.

Further features of the present invention will become apparent from the following description of exemplary embodiments with reference to the attached drawings.

DESCRIPTION OF THE EMBODIMENTS

Figure 1:
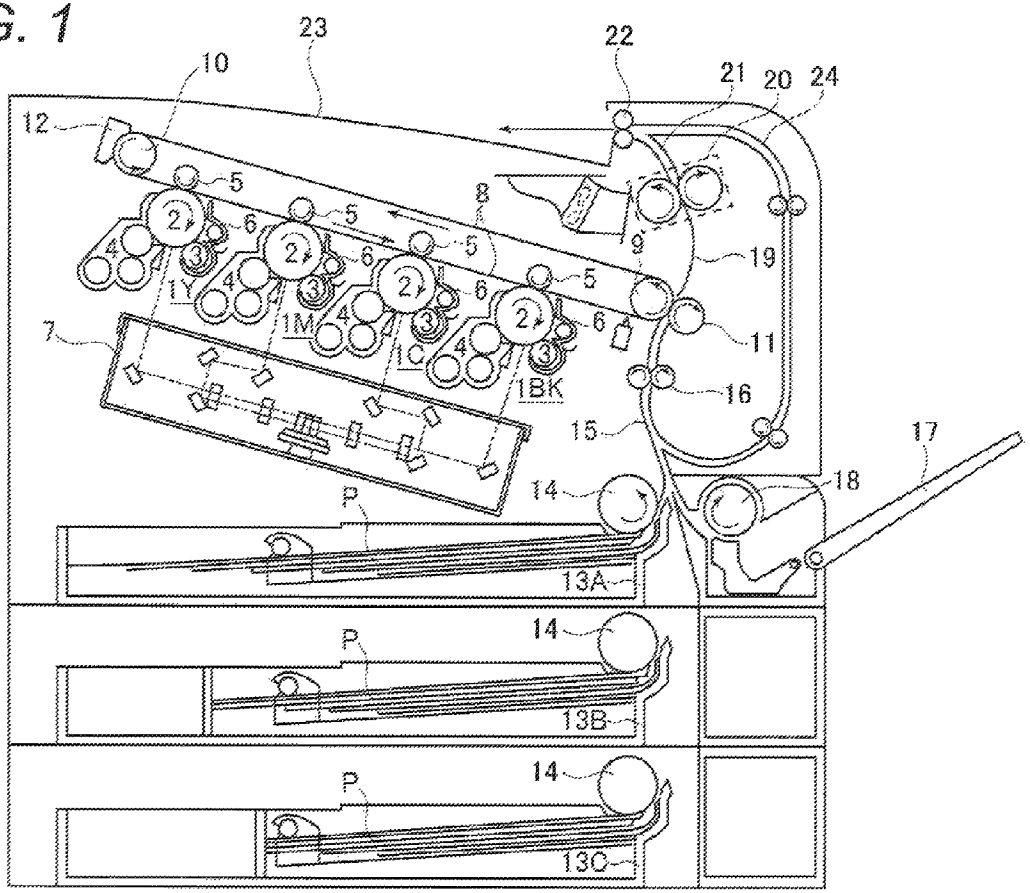
FIG. 1 is a longitudinal sectional view illustrating an example of an image forming apparatus mounted with a fixing apparatus according to an embodiment of the present invention.

Preferred embodiments of the present invention will now be described in detail in accordance with the accompanying drawings.

Hereinafter, the present invention is described more specifically by way of examples. It should be noted that these examples are each an example of an embodiment to which the present invention is applicable, but the present invention is not limited to these examples and can be variously modified within the scope of the concept of the present invention.

A fixing apparatus according to the present invention includes a first member, a second member, and a pressure member.

The first member (such as a fixing belt 650 in FIG. 2) is heated by a heat source and is rotatable.

The second member (such as a pressure roller 70 in FIG. 2) forms a nip portion capable of sandwiching a recording material between the first member and the second member, and is rotatable.

The pressure member (such as a heater 600 in FIG. 2) is disposed inside the first member, has a surface in contact with the inner surface of the first member, and pressurizes the first member against the second member.

A surface layer (such as a sliding coating layer 623 of FIG. 3) forming the surface of the pressure member in contact with the inner surface of the first member includes a diamond-like carbon film having an $sp^3$ bond ratio of 40% or more and 90% or less.

The pressure member preferably includes a substrate formed of ceramics and the surface layer formed on the surface of the substrate.

The ceramics is preferably aluminum nitride or alumina.

The diamond-like carbon film is preferably a ta-C film.

The diamond-like carbon film preferably has a ratio of the number of hydrogen atoms to the sum of the number of hydrogen atoms and the number of carbon atoms of more than 0% and 30% or less. The diamond-like carbon film more preferably has a ratio of the number of hydrogen atoms to the sum of the number of hydrogen atoms and the number of carbon atoms of more than 0% and 10% or less.

The thickness of the surface layer is preferably 0.1 μm or more and 10 μm or less.

Figure 4:
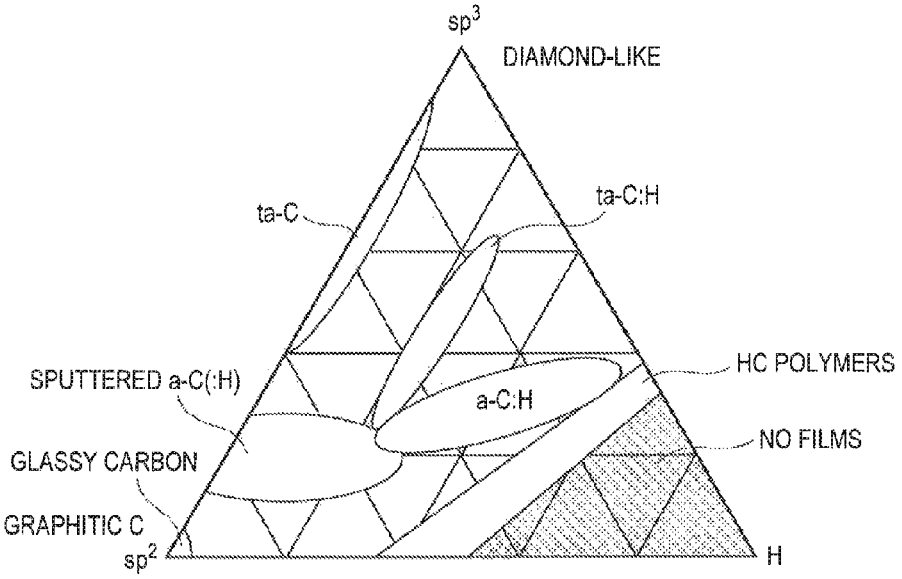
FIG. 4 is a ternary phase diagram of diamond-like carbon.

FIG. 4 is a ternary phase diagram formed of an $sp^2$ bond, an $sp^3$ bond, and hydrogen concerning a DLC disclosed in A. C. Ferrari, J. Robertson: Phys. Rev. B61 (2000) 14095.

A state of bonding between carbon atoms includes two kinds, i.e., the $sp^2$ bond and the $sp^3$ bond.

It should be noted that in the specification, the ratio ($sp^3/(sp^2+sp^3)$) of the $sp^3$ bond to the sum of the $sp^2$ bond and the $sp^3$ bond is also referred to as "$sp^3$ ratio".

The $sp^2$ bond is mainly the bonding state of graphite and the $sp^3$ bond is mainly the bonding state of diamond. Those two kinds of bonding states are present in a DLC in an amorphous manner. An arc ion plating method, sputtering method, or laser ablation method, involving using graphite as a raw material can be adopted as a method of forming the diamond-like carbon film (DLC film).

The $sp^3$ bond ratio of the diamond-like carbon (hereinafter sometimes referred to as "DLC") film is 40% or more and 90% or less.

When the $sp^3$ ratio is less than 40%, the abrasion resistance of the film is insufficient because the amount of the $sp^3$ bond as a high-energy bond is smaller. On the other hand, when the ratio exceeds 90%, the film has so high a hardness that the film becomes brittle, and hence its durability decreases. In addition, the $sp^3$ bond ratio is particularly preferably 60% or more and 80% or less.

For the DLC, a DLC having a smaller content of hydrogen atom (hereinafter sometimes referred to as "hydrogen-free DLC") can also be used. For example, a ta-C, which is one kind of the hydrogen-free DLC, can be used.

The hydrogen-free DLC is excellent in abrasion resistance because of its high hardness. However, the hydrogen-free DLC is weak against an elastic deformation such as bending or elongation because it is brittle. Accordingly, the DLC film may be liable to peel depending on the rigidity of the substrate on which the DLC film is to be formed.

Accordingly, a hydrogen-free DLC having a ratio (H/(H+C)) of the number of hydrogen atoms (H) to the sum of the number of hydrogen atoms (H) and the number of carbon atoms (C) of more than 0% and 30% or less is preferably used as the hydrogen-free DLC film. A hydrogen-free DLC film having a ratio (H/(H+C)) of more than 0% and 10% or less is particularly preferred from the viewpoints of its peeling suppression and its durability.

The thickness of the DLC film is preferably 0.1 μm or more and 10 μm or less. Setting the thickness to 0.1 μm or more can secure sufficient abrasion resistance. In addition, setting the thickness to 10 μm or less can suppress an increase in cost due to the use of the DLC film in the fixing apparatus.

A substrate on which the DLC film is formed (a substrate 610 in FIG. 2 or 3) is a flat and stripe substrate having high heat resistance, high electrical insulating property, high rigidity, and high heat conductivity. The substrate may be formed of ceramics such as alumina ($Al_2O_3$) or aluminum nitride (AlN).

In addition, the DLC film having an $sp^3$ bond ratio of 40% or more and 90% or less according to the present invention is excellent in adhesiveness with a substrate formed of any such materials. Accordingly, even when the back surface of the first member, specifically, for example, the fixing belt and the surface of the pressure member are caused to slide on each other over an extended period of time, the DLC film hardly peels from the substrate.

According to the present invention, a fixing apparatus can be obtained which is reduced in cost, has high durability, can suppress the increase in its rotational torque, and hardly causes abnormal sounds or image defect due to the increased rotational torque or stick-slip.

EXAMPLE 1

Image Forming Portion

FIG. 1 is a longitudinal schematic sectional view illustrating the construction of an electrophotographic full-color printer as an example of an image forming apparatus mounted with the fixing apparatus according to the present invention. First, the outline of its image forming portion is described.

The printer can perform an image forming operation according to input image information from an external host apparatus (not shown) communicably connected to a CPU 100 (control circuit portion) to form and output a full-color image on a recording material.

The external host apparatus includes a computer, an image reader, or the like. The CPU 100 transmits and receives a signal to and from the external host apparatus. In addition, the CPU governs image forming sequence control by transmitting and receiving signals to and from various kinds of image forming equipment.

An endless and flexible intermediate transfer belt (hereinafter abbreviated as "belt") 8 is stretched over a secondary transfer counter roller 9 and a tension roller 10, and the belt is rotationally driven in a counterclockwise direction indicated by an arrow at a predetermined speed when the roller 9 is driven. A secondary transfer roller 11 is brought into press contact with the secondary transfer counter roller 9 through the belt 8. An abutting portion between the belt 8 and the secondary transfer roller 11 is a secondary transfer portion.

Four image forming portions, i.e., first to fourth image forming portions 1Y, 1M, 1C, and 1Bk are disposed in a line below the belt 8 along the moving direction of the belt at a predetermined interval. Each image forming portion is an electrophotographic process mechanism of a laser exposure system and includes a drum-type electrophotographic photosensitive member (hereinafter abbreviated as "drum") 2 as an image bearing member rotationally driven in a clockwise direction indicated by an arrow at a predetermined speed.

Disposed around each drum 2 are a primary charging unit 3, a developing apparatus 4, a transfer roller 5 as a transferring unit, and a drum cleaner apparatus 6. Each transfer roller 5 is disposed inside the belt 8 and is brought into press contact with the corresponding drum 2 through the downstream side belt portion of the belt 8. An abutting portion between each drum 2 and the belt 8 is a primary transfer portion. A laser exposure apparatus 7 for the drum 2 of each image forming portion includes, for example, a laser light emitting unit that emits light corresponding to the time-series electric digital pixel signal of given image information, a polygon mirror, and a reflecting mirror.

The CPU 100 causes each image forming portion to perform an image forming operation based on a color separation image signal input from the external host apparatus. Thus, a toner image of a yellow, magenta, cyan, or black color is formed on the surface of the drum 2 rotating in each of the first to fourth image forming portions 1Y, 1M, 1C, and 1Bk at a predetermined control timing. It should be noted that the description of an electrophotographic image forming principle and process for forming the toner image on the drum 2 is omitted because the principle and process are known.

The respective toner images formed on the surfaces of the drums 2 in the image forming portions are sequentially superimposed and transferred at the primary transfer portions onto the outer surface of the belt 8 rotationally driven in a forward direction with respect to the rotation direction of each drum 2 and at a speed corresponding to the rotation speed of each drum 2. Thus, an unfixed full-color toner image as a result of the superimposition of the four color toner images is synthetically formed on the outer surface of the belt 8.

Meanwhile, a sheet feeding roller 14 of a sheet feeding cassette on a selected stage out of multiple vertically disposed cassette sheet feeding portions 13A, 13B, and 13C in each of which recording materials P having various widths and sizes have been loaded and stored is driven at a predetermined sheet feeding timing. Thus, a sheet of the recording materials P loaded and stored in the sheet feeding cassette on the corresponding stage is separated and fed, and is then passed through a longitudinal conveying path 15 and conveyed to a registration roller 16.

When manual paper feeding mode is selected, a sheet feeding roller 18 is driven. Thus, one of the recording materials loaded and set on a manual bypass tray (multipurpose tray) 17 is separated and fed, and is then passed through the longitudinal conveying path 15 and conveyed to the registration roller 16.

The registration roller 16 conveys the recording material P at such a timing that the front end portion of the recording material P reaches the secondary transfer portion in correspondence with the timing at which the front end of the full-color toner image on the rotating belt 8 reaches the secondary transfer portion. Thus, the full-color toner image on the belt 8 is collectively and sequentially subjected to secondary transfer onto the surface of the recording material P at the secondary transfer portion, and hence an unfixed toner image is formed on the recording material P. The recording material that has exited the secondary transfer portion is separated from the surface of the belt 8, and is guided by a longitudinal guide 19 and introduced into a fixing apparatus (fixing unit) 20.

The unfixed toner image of multiple colors is melted and subjected to color mixing, and is fixed as a permanently fixed image on the surface of the recording material by the fixing apparatus 20. The recording material that has exited the fixing apparatus 20 is passed as a full-color image-formed product through a conveying path 21 and is fed onto a sheet discharge tray 23 by a sheet discharge roller 22.

The surface of the belt 8 after the separation of the recording material at the secondary transfer portion is subjected to the removal of a residual adhering substance such as secondary transfer residual toner and cleaned by a belt cleaning apparatus 12, and is repeatedly subjected to image formation. In the case of a monochromatic printing mode, the image forming operation with only the fourth image forming portion 1Bk for forming a black toner image is conducted. When a duplex printing mode is selected, the recording material on one surface of which an image has already been printed is fed onto the sheet discharge tray 23 by the sheet discharge roller 22, and the rotation of the sheet discharge roller 22 is reversed immediately before the rear end portion of the recording material passes the sheet discharge roller 22. Thus, the recording material is switched back and introduced into a re-conveying path 24. Then, the recording material is brought into a state in which its front and back surfaces are reversed, and is conveyed to the registration roller 16 again.

Subsequently, as in the time of the printing on the one surface, the recording material is conveyed to the secondary transfer portion and the fixing apparatus 20, and is fed as an image-formed product having images printed on its both sides onto the sheet discharge tray 23.

Fixing Apparatus

Figure 2:
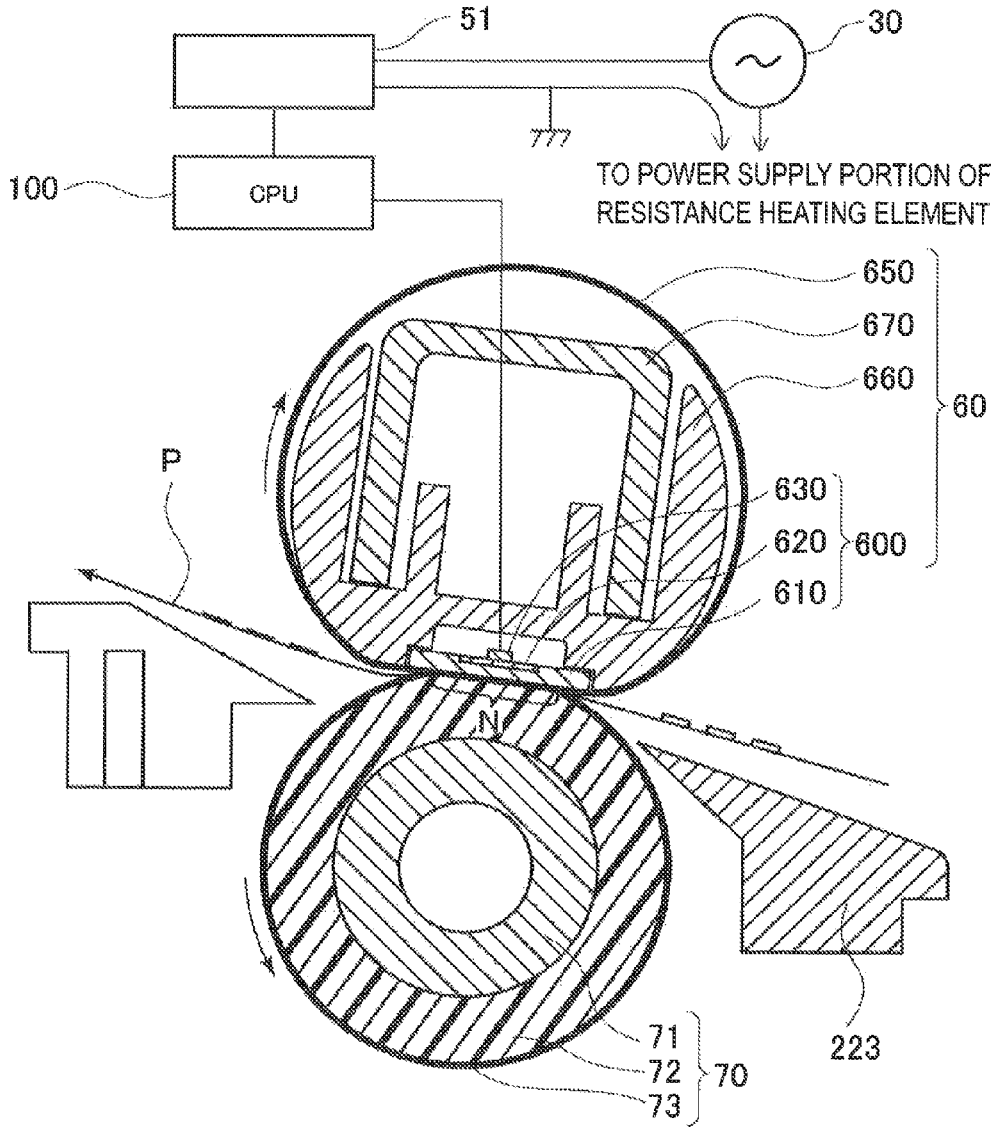
FIG. 2 is a sectional view illustrating the construction of a fixing apparatus of Example 1.

FIG. 2 is a schematic construction view of the fixing apparatus 20.

A heater unit 60 includes the heater 600 as a heating body, a film guide 660 (heater holder) whose cross section is of a semicircular gutter shape, a reinforcing sheet metal 670 of an inverse U letter shape, and the fixing belt 650.

The heater 600 doubles as a pressuring member and a heat source. The heater 600 is disposed inside the fixing belt 650. The film guide 660 is a support for supporting the heater 600. The reinforcing sheet metal 670 is provided for preventing the heater unit 60 from deforming when the unit is pressurized by the pressure roller 70 (second member). The fixing belt 650 (first member) is formed of a heat-resistant cylindrical film.

The fixing belt 650 is heated by the heat source and is rotatable. The pressure roller 70 forms a nip portion capable of sandwiching a recording material between the fixing belt 650 and the pressure roller 70, and is rotatable.

The heater 600 includes the insulative, heat-resistant, low-heat capacity substrate 610 whose longitudinal direction is perpendicular to the conveying direction of the recording material P, a resistance heating element 620, and a thermistor 630 as a temperature detector element. The heater 600 is fixed to and supported by the film guide 660. The fixing belt 650 is obtained by forming a silicone rubber layer (elastic layer) having a thickness of about 300 μm on a cylindrical base material, which is obtained by forming stainless steel into a cylindrical shape having a thickness of 30 μm, according to a ring coating method. Further, the belt is of a structure in which the top of the layer is coated with a PFA resin tube having a thickness of 20 μm as an outermost surface layer.

For example, a polyimide film having a thickness of 4 μm is formed on the inner surface of the fixing belt 650 for improving its sliding property with respect to the substrate 610. The thickness of the polyimide film is preferably set to 1 μm or more from the viewpoint of durability. In addition, the thickness is preferably set to 20 μm or less from the viewpoint of suppressing a reduction in heat transfer efficiency.

A heat-resistant fluorine-based lubricant is applied as a heat-resistant lubricant to the inner surface of the fixing belt 650, and the fixing belt 650 and the sliding coating layer 623 (FIG. 3) of the substrate 610 are rubbed together in a state in which the fluorine-based lubricant is interposed therebetween. The fixing belt 650 rotates in a state in which the grease-like heat-resistant lubricant containing fluorine-based fine particles and a fluorine-based oil adheres to its inner surface.

A heat-resistant grease MOLYKOTE (trademark) HP300 manufactured by Dow Corning Toray Co., Ltd. was used in this example. In addition to the foregoing, a silicon-based heat-resistant oil may be used as the heat-resistant lubricant.

In addition, the pressure roller 70 as the second member is provided below such heater unit 60 as described above.

The pressure roller 70 includes a mandrel 71, an elastic layer 72 formed of a silicone rubber, and a surface layer 73 formed of a fluorine-based resin. The pressure roller 70 is of a multilayer structure in which the elastic layer 72 formed of a silicone rubber having a thickness of about 3 mm and the surface layer 73 formed of a PFA resin tube having a thickness of about 40 μm are laminated in the stated order on the mandrel 71 made of stainless steel.

Both end portions of the mandrel of the pressure roller 70 are rotatably held with bearings between side plates on the back side (not shown) and near side of an apparatus frame. The pressure roller 70 is pressurized against the heater unit 60 by a pressure unit (not shown) at a total pressure of from 90 to 320 N, and is rotationally driven (counterclockwise) by a driving system (not shown) so as to convey the recording material P in a direction indicated by an arrow. Thus, the cylindrical fixing belt 650 slides on the surface of the heating element of the heater 600 in a state that it is in close contact with the surface, thereby rotating around the film guide 660.

The fixing unit including the heater 600, the heater holder 660, and the fixing belt 650 is placed above the pressure roller 70. The fixing unit is placed so as to be parallel to the pressure roller 70 with its heater 600 side directed downward.

The heater 600 is fixed to the lower surface of the heater holder 660 along the longitudinal direction of the heater holder, and is of such a construction that the fixing belt and its heating surface can slide with respect to each other. In addition, the fixing belt 650 is loosely fitted externally to the heater holder 660.

The heater holder 660 is formed of a liquid crystal polymer resin having high heat resistance and serves to guide the fixing belt 650 as well as to hold the heater 600. In this example, ZENITE 7755 (trade name) manufactured by Du Pont was used as a liquid crystal polymer.

Both end portions of the heater holder 660 are biased in the shaft line direction of the pressure roller 70 by a pressure mechanism (not shown) at a force of 156.8 N (16 kgf) on one end side thereof, i.e., a total pressure of 313.6 N (32 kgf). As a result, the lower surface (heating surface) of the heater 600 is brought into press contact with the elastic layer of the pressure roller 70 through the fixing belt 650 at a predetermined pressing force, and hence a fixing nip portion N having a predetermined width capable of sandwiching the recording material is formed.

The thermistor 630 (heater temperature sensor or first temperature detector element) is placed on the back surface (surface opposite to the heating surface) of the heater 600 as a heat source to detect the temperature of the heater 600. Each thermistor 630 is connected to the control circuit portion (CPU) 100 as a control unit through an A/D converter. The CPU 100 is configured to sample an output from each thermistor in a predetermined cycle and reflect temperature information thus acquired in temperature control.

In other words, the CPU 100 determines the contents of the temperature control of the heater 600 based on the output of the thermistor 630 and controls the electrification of the heater 600 with a control portion 51 as a power supply portion.

The pressure roller 70 is rotationally driven in a direction indicated by an arrow at a predetermined circumferential speed. The fixing belt 650 in a state of being brought into press contact with the pressure roller 70 is driven to rotate at a predetermined speed by the pressure roller 70.

At this time, the fixing belt 650 is brought into a state of being driven to rotate along the circumference of the heater holder 660 in a direction indicated by an arrow while its inner surface slides in a state of being in close contact with the lower surface of the heater 600. Grease is applied to the inner surface of the fixing belt 650 to secure sliding property between the heater holder 660 and the inner surface of the fixing belt 650.

When the pressure roller 70 is rotationally driven and the cylindrical fixing belt 650 is brought into a state of being driven to rotate in association with the rotation, the heater 600 is electrified. Then, in a state in which the temperature of the hater 600 is regulated to rise to a preset temperature, the sheet P bearing an unfixed toner image is guided and introduced into the fixing nip portion N along an inlet guide 223.

At the fixing nip portion N, the toner image bearing surface side of the sheet P is brought into close contact with the outer surface of the fixing belt 650, and hence the sheet moves along with the fixing belt 650. In a process for the sandwiching and conveyance of the sheet P at the fixing nip portion, heat from the heater 600 is applied to the sheet P through the fixing belt 650, and hence the unfixed toner image is melted and fixed onto the sheet P. The sheet P that has passed the fixing nip portion N is separated and discharged from the fixing belt 650.

Heater

Figure 3:
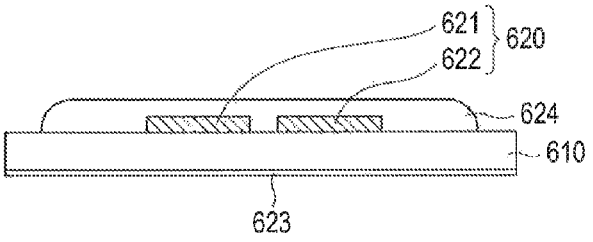
FIG. 3 is a sectional view illustrating the construction of a heater of Example 1.

FIG. 3 illustrates an enlarged sectional view of the heater 600 used in Example 1.

The heater 600 is disposed inside the fixing belt 650. The heater 600 includes the substrate 610, the resistance heating elements 620 each serving as a heat generating portion, and a glassy overcoat layer 624 that covers the surface of the elements for protection. The substrate 610 was a flat slot-shaped substrate formed of ceramics (aluminum nitride in this example) having a thickness of 1.0 mm.

The resistance heating elements 620 include two elements, i.e., a main resistance heating element 621 whose heat generation distribution peaks at its center so as to correspond to small-sized paper and a sub resistance heating element 622 whose heat generation distribution peaks at an end portion thereof instead.

The sliding coating layer 623 is a surface layer forming the surface of the heater 600 coming into contact with the inner surface of the fixing belt 650. The sliding coating layer 623 is formed on a sliding surface between the substrate 610 and the inner surface of the fixing belt. A ta-C having an $sp^3$ ratio of 80% was used as a material for the surface layer. In this example, a hydrogen-free DLC having a hydrogen atom ratio of 5% or less was used because the substrate 610 on a film side was a ceramics substrate.

The thickness of the sliding coating layer 623 was set to 0.5 μm.

COMPARATIVE EXAMPLE 1

A sheet passing durability test to be described later was performed in the same manner as in Example 1 except that the substrate 610 of the heater was not provided with the sliding coating layer 623.

Sheet Passing Durability Test

Figure 5:
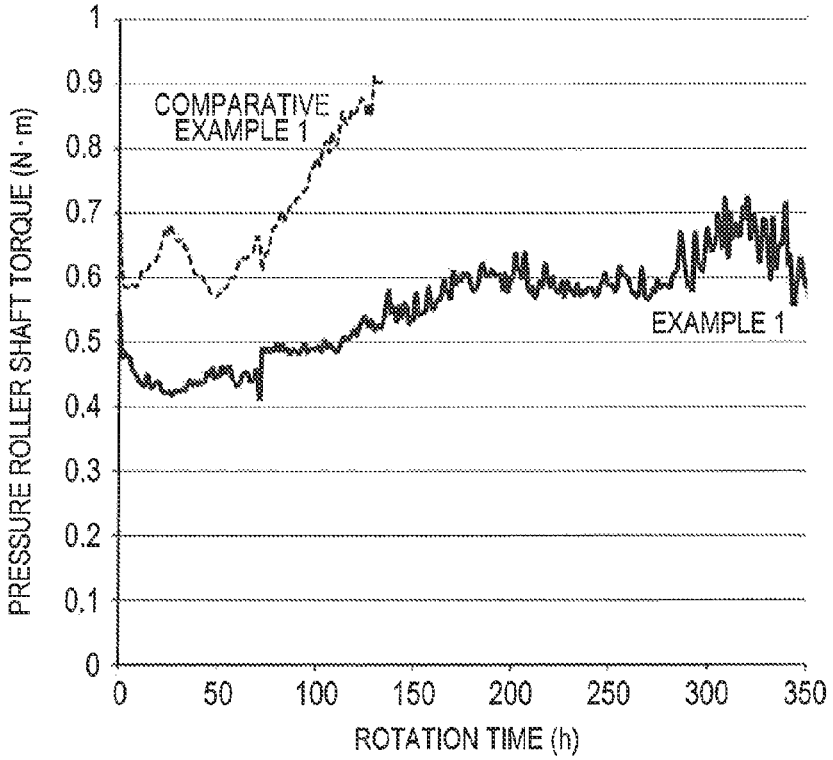
FIG. 5 is a view illustrating a change in shaft torque of a pressure roller with a rotation time.

FIG. 5 is a view illustrating a change in shaft torque of a pressure roller with a rotation time when the sheet passing durability test was performed in each of Example 1 and Comparative Example 1 at a fixation temperature of 200° C. The axis of abscissa of FIG. 5 indicates the rotation time of a fixing unit in the sheet passing durability test, and the axis of ordinate thereof indicates the shaft torque of the pressure roller. In FIG. 5, a solid line represents the results of Example 1 and a broken line represents the results of Comparative Example 1.

In Example 1, the torque was as low as 0.5 N·m at an initial stage and then the torque still ranged between values as low as from 0.4 to 0.6 N·m. This may be probably because the ta-C coating layer has a low abrasiveness effect, and the oil component of the fluorine grease has good wettability with the ta-C coating layer and hence effectively retains lubricity with respect to the sliding portion. In Example 1, even after a lapse of 350 hours, the torque did not exceed 0.8 N·m as a value causing problems, and good fixability was continuously retained.

On the other hand, in Comparative Example 1, the torque started from 0.7 N·m at an initial stage and then ranged between about 0.6 N·m and 0.7 N·m, and the torque increased to 0.8 N·m after a lapse of about 100 hours. When the torque value exceeded 0.8 N·m, abnormal sounds due to stick-slip started to occur between the inner surface of the belt and the sliding surface of the heater. Further, when the torque value increased to from 0.8 to 0.85 N·m, a frictional force between the inner surface of the belt and the sliding surface of the heater became higher than a driving force that the belt receives from the paper and the pressure roller, and hence a faulty image occurred.

EXAMPLE 2

Example 2 is an example in which the basic construction of the fixing unit of Example 1 is applied to a fixing apparatus using an induction heating system disclosed in Japanese Patent Application Laid-Open No. 2010-122450.

Figure 6:
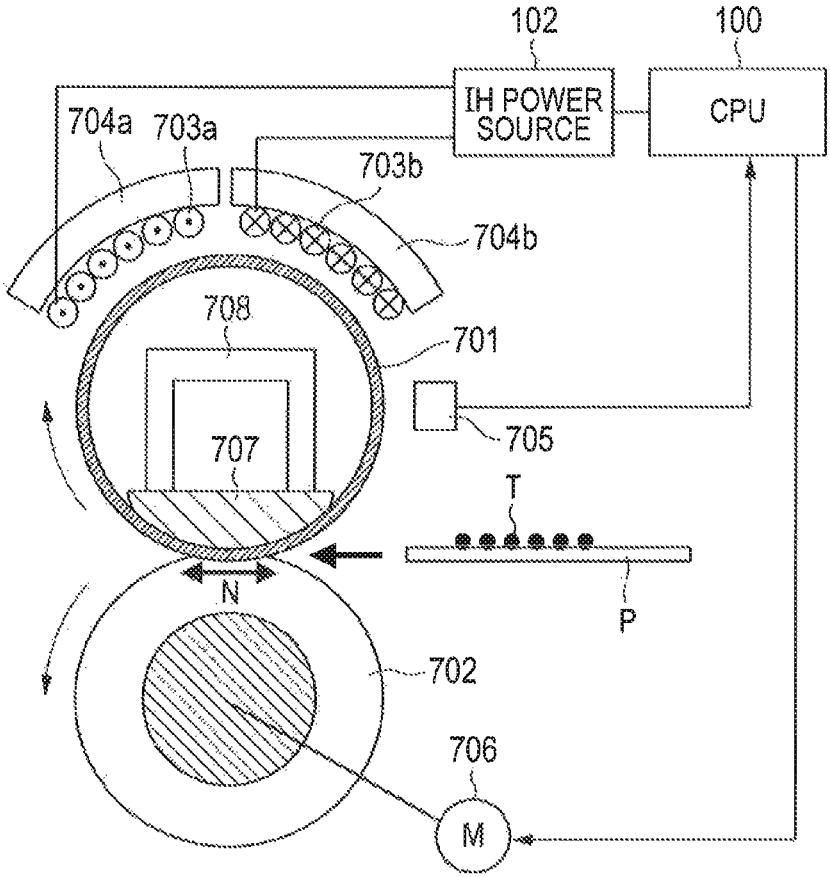
FIG. 6 is a sectional view illustrating the construction of a fixing apparatus of Example 2.

FIG. 6 illustrates the basic construction of the fixing apparatus used in this example.

A fixing belt 701 (first member) includes a conductive heating element (heat source), and when an IH power source 102 passes an AC current through IH coils 703*a* and 703*b* provided on cores 704*a* and 704*b* to generate a magnetic field, the conductive heating element of the fixing belt 701 generates heat. The fixing belt 701 is rotatable.

A pressure roller 702 (second member) forms the nip portion N capable of sandwiching a recording material between the fixing belt 701 and the pressure roller 702, and is rotatable.

The fixing belt 701 and the pressure roller 702 each have a separable construction (not shown). When the fixing belt 701 is rotated, the pressure roller 702 is in contact with the fixing belt 701 and the fixing belt 701 is driven to rotate by the pressure roller 702.

The inner surface of the fixing belt 701 was coated with a polyimide film having a thickness of 4 μm for improving sliding property as in Example 1.

A heat-resistant fluorine-based lubricant was applied as a heat-resistant lubricant to the inner surface of the fixing belt 701. The CPU 100 was connected to the IH power source 102, a motor M (driving apparatus 706) for driving the pressure roller, and a temperature sensor 705, and performed, for example, control for keeping the surface temperature of the belt 701 constant and the control of the rotation of the belt 701 by the driving apparatus 706.

A pressure member 707 (pressure member) is disposed inside the fixing belt 701, has a surface in contact with the inner surface of the fixing belt 701, and pressurizes the fixing belt 701 against the pressure roller 702.

The pressure member 707 is formed of a heat-resistant resin such as polyphenylene sulfide (PPS), polyether ether ketone (PEEK), a phenol resin, or a liquid crystal polymer.

The pressure member 707 is pressurized in the direction of the pressure roller by a U-shaped pressure stay 708. The pressure member 707 was provided with a ta-C coating layer in the same manner as in Example 1 on its surface coming into contact with the inner surface of the fixing member 707, corresponding to a region in a circular arc shape as shown in the sectional view of FIG. 6.

In this example as well, the same sheet passing durability test as that of Example 1 was performed. As a result, it was confirmed that as in Example 1, even after a lapse of 350 hours, no torque increase occurred and good fixing performance could be retained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-143643, filed Jul. 9, 2013, which is hereby incorporated by reference herein in its entirety.

What is claimed is:

1. A fixing apparatus, comprising:

a first member that is heated by a heat source and is rotatable;

a second member that is rotatable, the second member forming a nip portion with the first member, the nip portion being capable of sandwiching a recording material; and a pressure member that is disposed inside the first member and that pressurizes the first member against the second member, wherein the pressure member comprises a substrate formed of ceramics and a surface layer directly formed thereon, the ceramics comprising one of aluminum nitride and alumina, and wherein the surface layer, which comes into contact with an inner surface of the first member, comprises a diamond-like carbon film having an $sp^3$ bond ratio of 40% to 90%.

2. The fixing apparatus according to claim 1, wherein the diamond-like carbon film comprises a ta-C film.

3. The fixing apparatus according to claim 1, wherein the diamond-like carbon film has a ratio of a number of hydrogen atoms to a sum of the number of hydrogen atoms and a number of carbon atoms of more than 0% to 30%.

4. The fixing apparatus according to claim 3, wherein the ratio is more than 0% to 10%.

5. The fixing apparatus according to claim 1, wherein the surface layer has a thickness of 0.1 μm to 10 μm.

6. The fixing apparatus according to claim 1, wherein the pressure member comprises the heat source.

7. The fixing apparatus according to claim 1, wherein the first member comprises a cylindrical film.

8. An image forming apparatus, comprising a fixing apparatus that heats an unfixed toner image on a recording material to fix the image onto the recording material, wherein the fixing apparatus comprises the fixing apparatus according to claim 1.

* * * * *